US006244260B1

(12) United States Patent
Ragoza et al.

(10) Patent No.: US 6,244,260 B1
(45) Date of Patent: Jun. 12, 2001

(54) INTERACTIVE PROJECTILE-DISCHARGING TOY

(75) Inventors: Mark Ragoza, Hatfield; Bruce E. Foster; Peter C. Ferraro, both of Ipswich, all of MA (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 09/493,095

(22) Filed: Jan. 28, 2000

(51) Int. Cl.[7] ..... F41B 4/00
(52) U.S. Cl. ..... 124/34; 124/6; 124/32
(58) Field of Search ..... 124/6, 32, 34, 124/78; 473/451

(56) References Cited

U.S. PATENT DOCUMENTS

| | | | | |
|---|---|---|---|---|
| 3,568,199 | * | 3/1971 | Hartness | 124/34 X |
| 3,589,719 | | 6/1971 | Glass et al. . | |
| 3,785,358 | * | 1/1974 | D'Angelo et al. | 124/34 X |
| 3,849,931 | | 11/1974 | Gulley, Jr. . | |
| 4,097,917 | | 6/1978 | McCaslin . | |
| 4,181,911 | * | 1/1980 | Black | 124/34 X |
| 4,915,384 | * | 4/1990 | Bear | 473/451 |
| 4,938,483 | | 7/1990 | Yavetz . | |
| 4,973,052 | | 11/1990 | Conti . | |
| 5,271,627 | | 12/1993 | Russell et al. . | |
| 5,471,967 | | 12/1995 | Matsuzaki et al. | 124/6 |
| 5,505,463 | | 4/1996 | Hirose et al. . | |
| 5,611,322 | | 3/1997 | Matsuzaki et al. | 124/6 |
| 5,878,956 | | 3/1999 | Djukastein et al. | 239/69 |

* cited by examiner

*Primary Examiner*—John A. Ricci
(74) *Attorney, Agent, or Firm*—Fish & Richardson P.C.

(57) ABSTRACT

An electronic game includes a device that is held or worn by a player, and a housing. The device includes an emitter that emits a signal in response to player input. The housing includes a controller and a detector that detects the signal from the emitter and provides an electrical signal to the controller indicating the location of the emitter. The housing further includes a magazine for storing objects, and a fire mechanism coupled to the magazine and controlled by the controller to fire a stored object at the implement when the controller determines that the detector has detected an emitted signal from the emitter.

18 Claims, 12 Drawing Sheets

INTERACTIVE PROJECTILE-DISCHARGING TOY

TECHNICAL FIELD

This invention relates to an interactive projectile-discharging toy.

BACKGROUND

Projectile-discharging toys are well known. For example, in U.S. Pat. No. 5,471,967, a toy in the shape of a pistol discharges a disc when a player presses a trigger on the toy.

SUMMARY

In one general aspect, the invention provides an electronic game that includes a housing and device that is held or worn by a player. The device includes an emitter that emits a signal. Moreover, the housing includes a controller and a detector that detects the signal from the emitter and provides an electrical signal to the controller indicating the location of the emitter. The housing further includes a magazine for storing objects, and a fire mechanism coupled to the magazine and controlled by the controller to fire a stored object at the device when the controller determines that the detector has detected a signal from the emitter.

Embodiments may include one or more of the following features. For example, the device may include a speaker that emits one or more audio signals in response to player input. The emitter also may emit the signal in response to player input.

The emitter may include a light emitting diode, and the signal emitted from the emitter may be an electromagnetic signal. The emitter may be configured to emit the electromagnetic signal in the infrared wavelength region, and the detector may be configured to detect the electromagnetic signal emitted in the infrared wavelength region. To this end, the detector may include a photodiode detector. The detector also may be configured to detect a signal based on characteristics of the signal.

The electronic game may further include a supporting post on which the housing is mounted. When this is the case, the housing may include a mechanical rotator that is electrically controlled by the controller and is coupled to the post. The controller may determine that the emitted signal has been detected by causing the rotator to rotate the housing relative to the post and toward the signal. The controller may further determine whether a value of the electrical signal remains above a predetermined threshold for a predetermined period of time. When the controller determines that the detector has detected an emitted signal from the emitter, the controller may cause a speaker in the housing to emit an acoustic warning signal. The acoustic warning signal may be based on input from the player.

The housing may include a speaker controlled by the controller to emit an acoustic signal. The controller may thus cause the speaker to emit an acoustic game over signal when the controller determines that a predetermined number of objects have been fired from the magazine.

The object may be a sponge-like material and shaped in the form of a disc.

Other features and advantages will be apparent from the following description, including the drawings, and from the claims.

DETAILED DESCRIPTION

Figure 1:
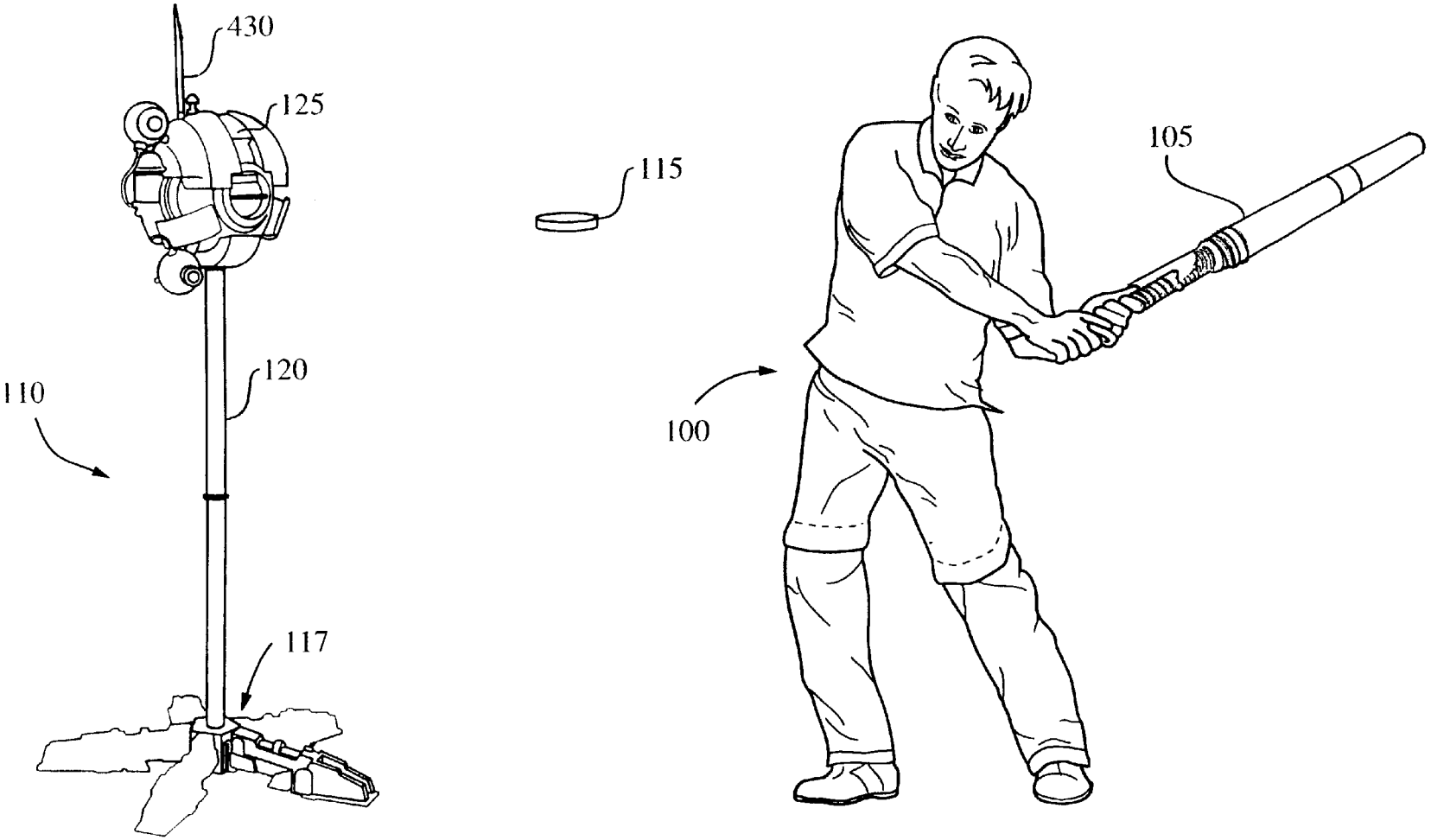
FIG. 1 is a perspective view of a game involving a toy body and a device held by a player.

In FIG. 1, a player 100 holds and controls a device 105. A toy 110 produces an output when it detects a signal emitted from the device 105. For example, the device 105 may emit a signal that is detected by the toy 110 when the player presses a button on the device 105. The toy 110 responds to the signal by emitting or shooting an object 115 toward the player 100.

The device 105 may be in the shape of a sword or a weapon that is used to block the object 115 shot at the player 100. The device 105 is preferably made of a durable, safe, and inexpensively fabricated material, for example, plastic. To facilitate shipping, the device 105 may be formed into several pieces that may be easily assembled by the player without the aid of additional tools. The pieces may mate with each other using any suitable fastening mechanism, such as, for example, using matching threads formed on the pieces.

The toy 110 includes a base 117 that supports a post 120 that couples to a body 125. The body 125 rotates relative to the post 120 during game play. The base 117, post 120, and body 125 are made of plastic, with individual smaller components made of rubber or plastic. To facilitate shipping, the body 125 may be made to detach from the post 120, which also may be detached from the base 117. These parts may mate with each other using various fastening mechanisms, including snap-fit features and mating threaded features.

The object 115 is preferably made of a resilient, compressible material, such as, for example, a sponge made of rubber, cellulose, or plastic, to prevent injury to the player 100. In particular, the object 115 may be made of vinyl chloride, a blow-formed article of urethane foam, or a polyethylene foam. Moreover, to increase aerodynamics and facilitate shooting, the object 115 is shaped in the form of a toroidal disc.

Figure 2:
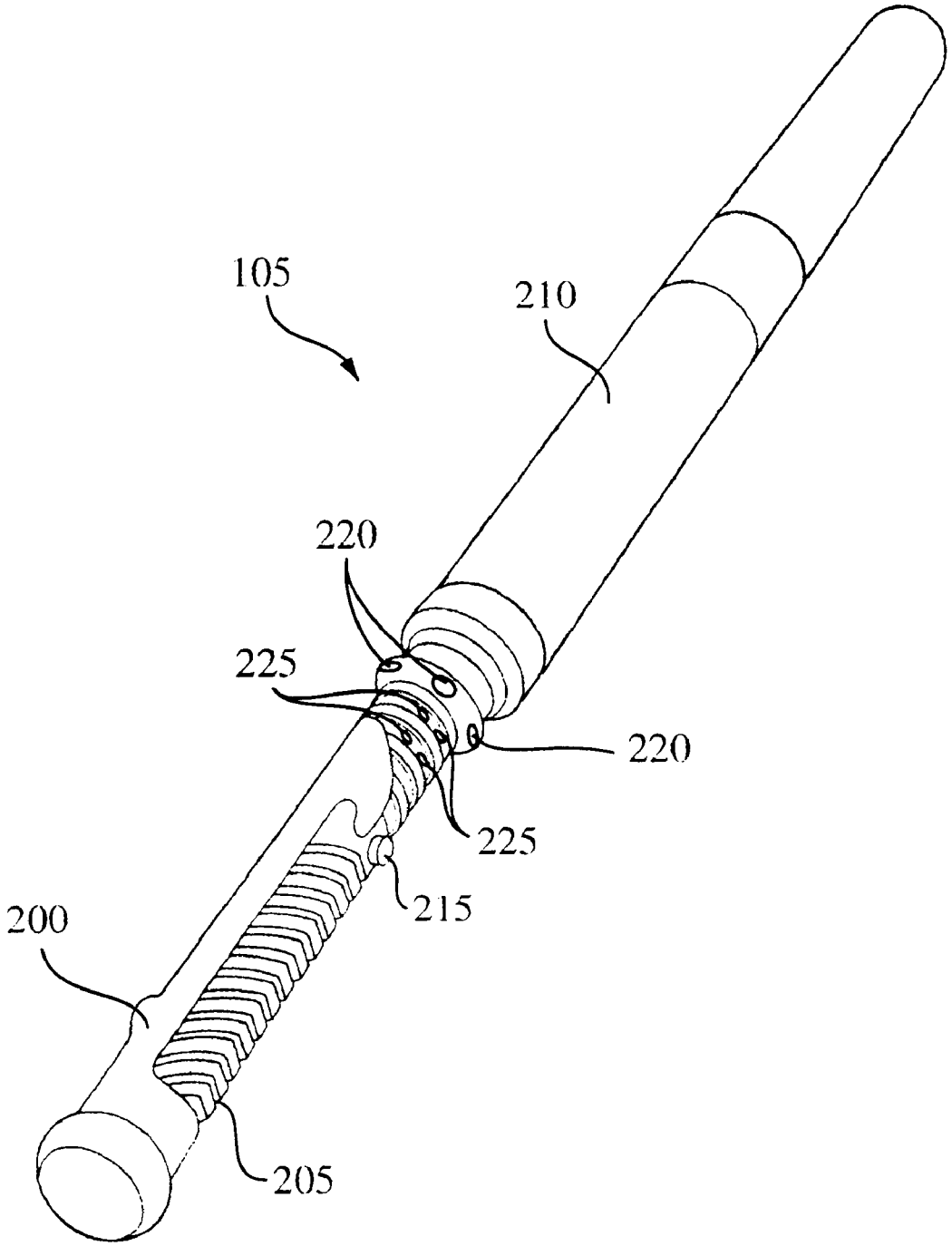
FIG. 2 is a perspective view of the hand held device of FIG. 1.

Referring also to FIG. 2, the device 105 includes a handle 200 shaped to fit the player's hands. For example, a grooved side 205 may be shaped into the handle 200 to help the player grip the device 105. The device 105 also includes an upper segment 210 connected to the handle 200. An on button 215 is formed into the handle 200 to control electronics positioned within the device, such as a speaker, a power source, a controller, and one or more light emitters 220.

The light emitters 220 are positioned along an outer perimeter of the device 105 at unobstructed positions. For example, a light emitter 220 may be placed at the top of the handle 200 and away from the player's hands. The light emitter 220 may be a light emitting diode ("LED") that emits electromagnetic radiation in the infrared wavelength region. In this way, the light emitted from the device 105 is invisible to the player, which makes the game more entertaining.

The speaker may be positioned within the handle 200. Holes or slots 225 are formed in the handle to permit sound from the speaker to emanate from the device without being muffled.

Figure 3:
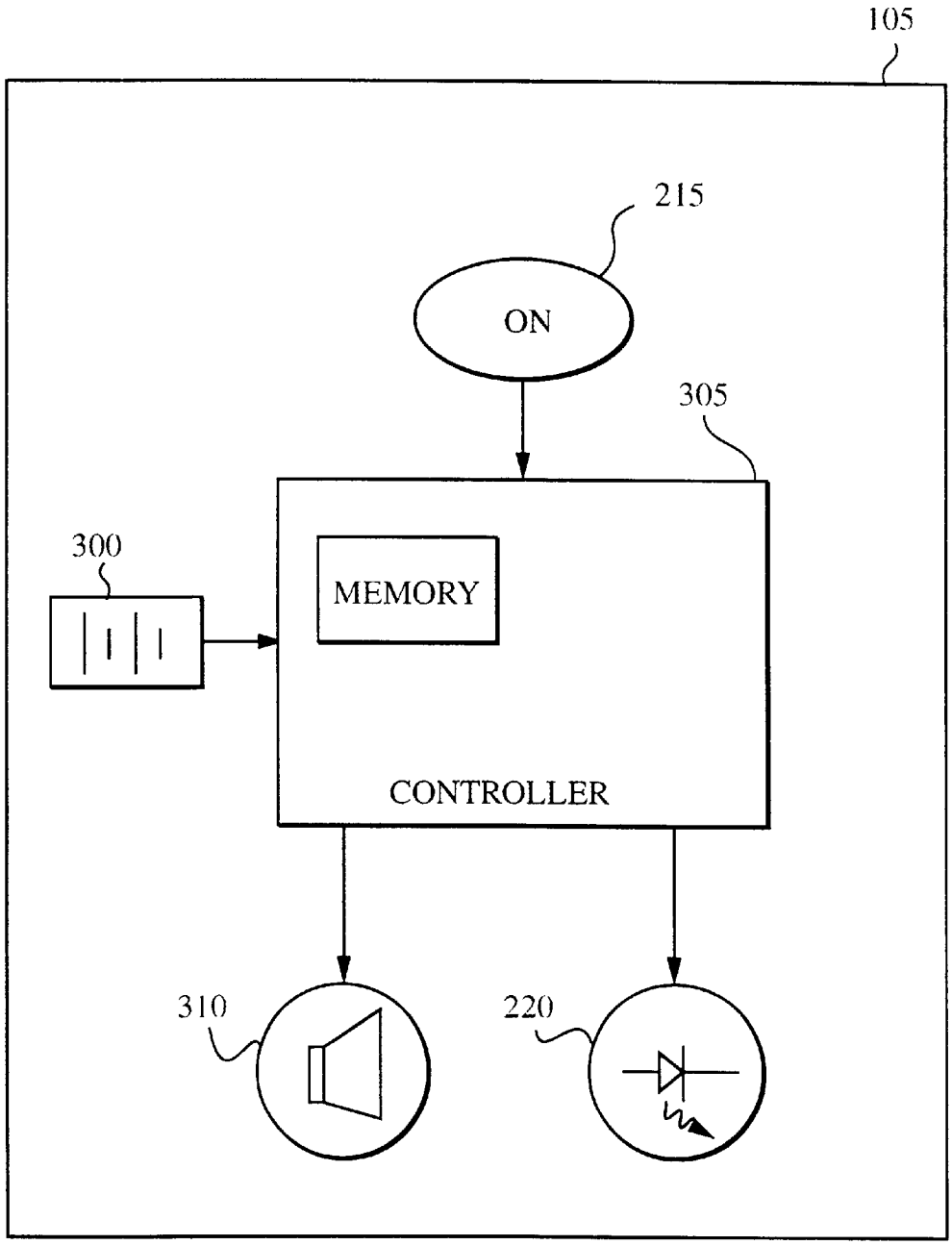
FIG. 3 is a block diagram of the hand held device of FIG. 2.

Referring also to FIG. 3, the handle 200 contains the power source 300, which may be one or more batteries retained in a battery holder (not shown). The controller 305 is also housed within the handle 200. The controller 305 receives input from the power source 300 and the on button 215. In response to this input, the controller 305 operates the light emitters 220 and the speaker 310. The electrical components—controller 305, power source 300, light emitters 220, and speaker 310—are retained in the handle 200 to enable the player to easily maneuver the device during play.

Figure 4A:
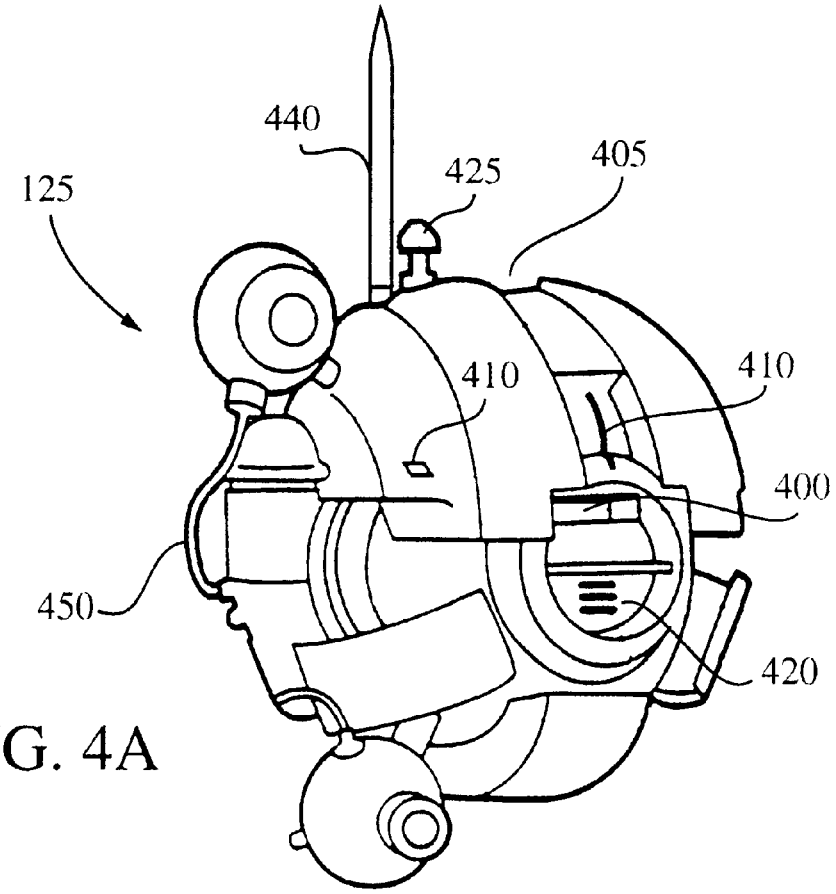
FIGS. 4A and 4B are, respectively, front and back perspective views of the toy body of FIG. 1.
Figure 4B:
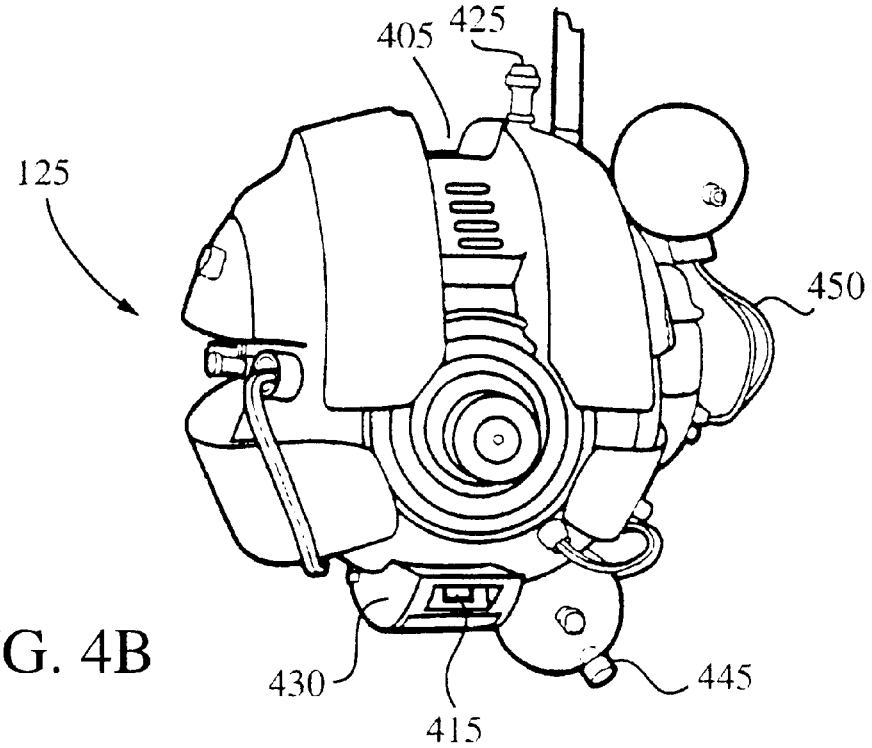
Figure 4C:
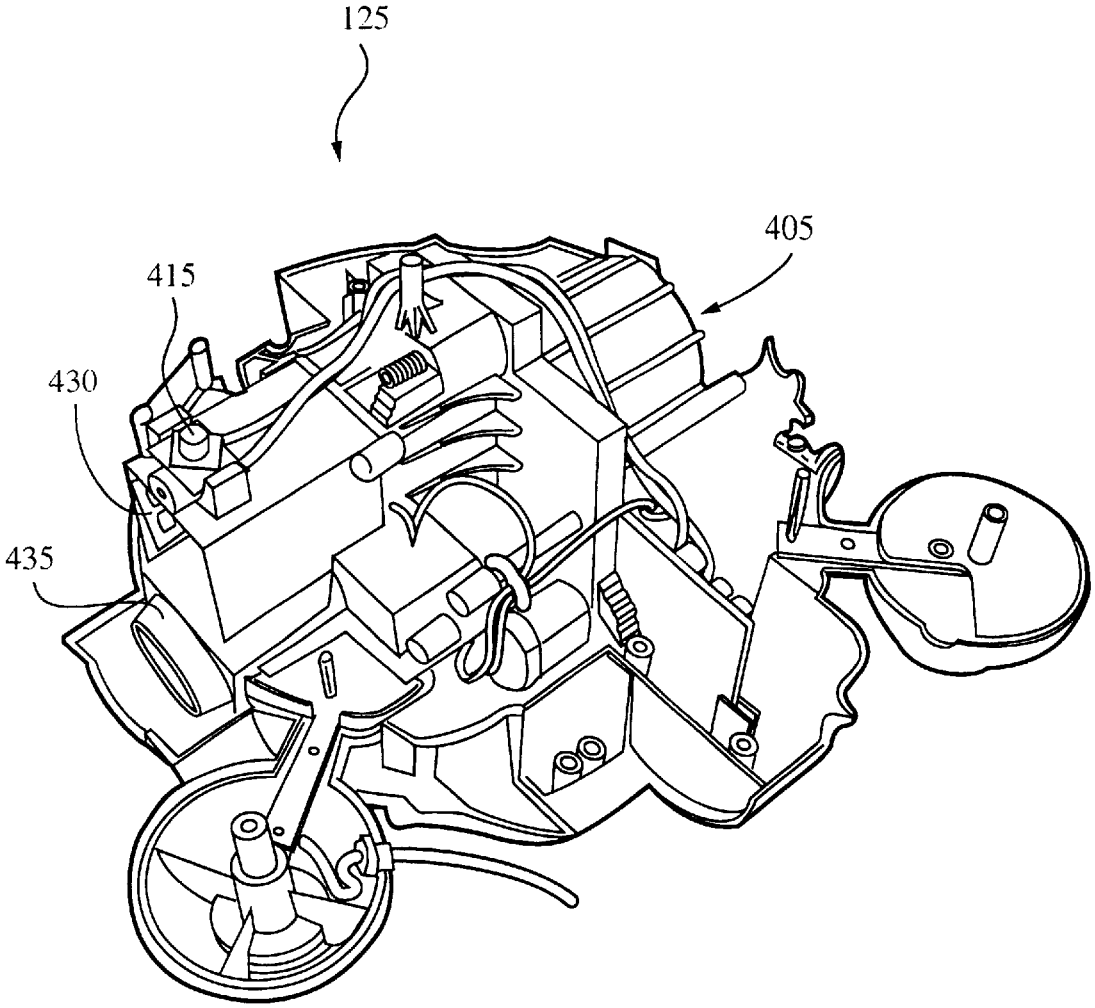
FIG. 4C is a cross sectional back perspective view of the toy body of FIG. 1.

Referring also to FIGS. 4A–C, the body 125 includes a barrel 400 for launching the objects 115, and a supply section or magazine 405 coupled to the barrel 400 through a firing mechanism. The magazine 405 is used for loading the objects 115 from the top of the body 125 and supplying the objects, 115 to the barrel 400. When an object is fired, the fire mechanism seizes an object 115 from the magazine 405 and launches that object through the barrel 400.

The body 125 also includes signal detectors 410, such as, for example, photodiode detectors, for detecting the radiation emitted by the light emitters 220 of the device 105. As such, the signal detectors 410 may be optimized based on the wavelength of the emitted light.

An on button 415 is used for turning on the body 125. Additionally, a speaker, a power source, and a body controller are housed inside the body 125. Slots 420 are formed on the body 125 to permit sound to freely emanate from the speaker in the body 125.

A compartment 430 is formed on the bottom of the body 125 to house the power source. The compartment 430 may be opened and closed using, for example, a screwdriver or a snap-fit feature. A rotator 435 couples the body 125 to the post 120. The rotator 435 grips the post 120 and causes the body 125 to rotate around the longitudinal axis of the post 120.

Several exterior cosmetic features may be incorporated into the design of the body 125 as shown in FIGS. 4A–C. Such features contribute to an android-like appearance of the body 125. For example, an antenna 440, various knobs 445, or wires 450 may be placed on the body 125.

Figure 5A:
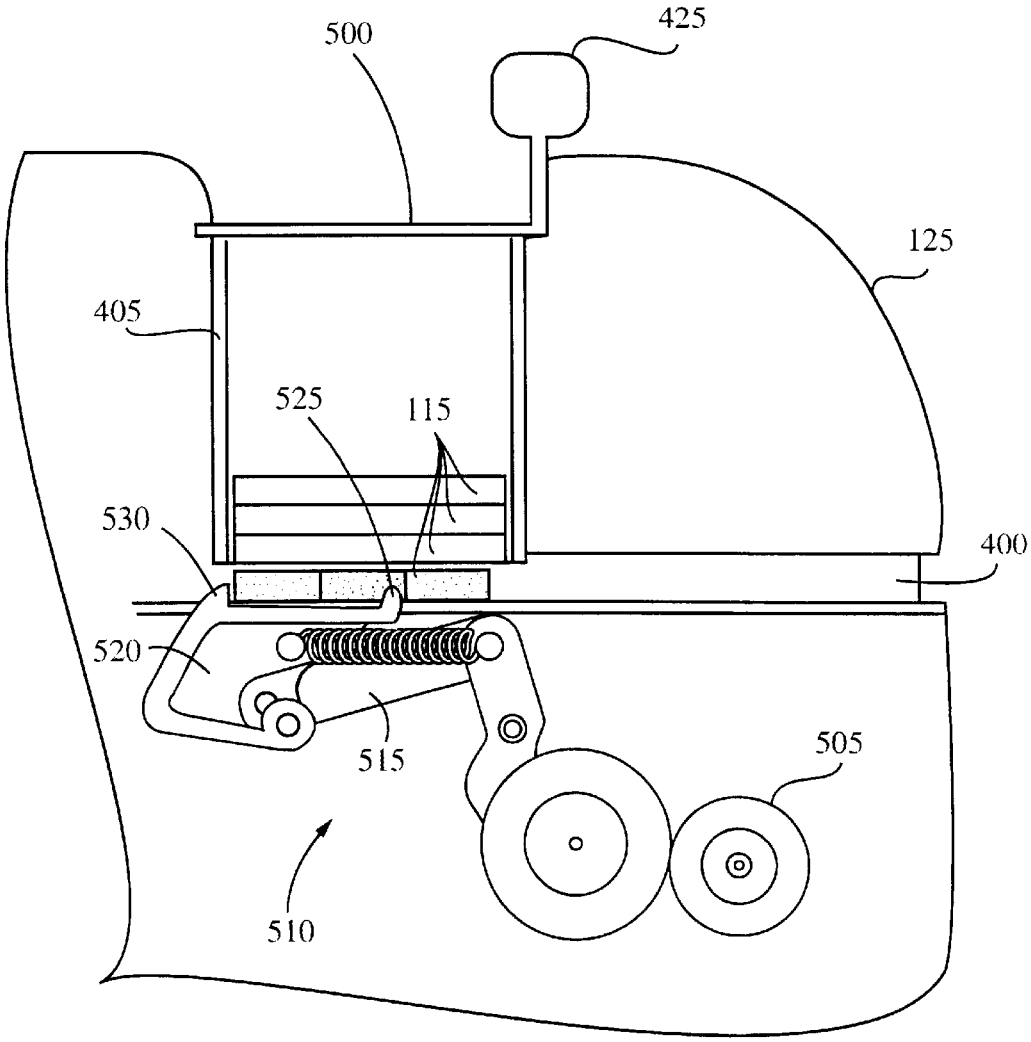
FIG. 5A is a side cross-sectional view of the toy body of FIG. 1, with portions removed to illustrate the interior.
Figure 5B:
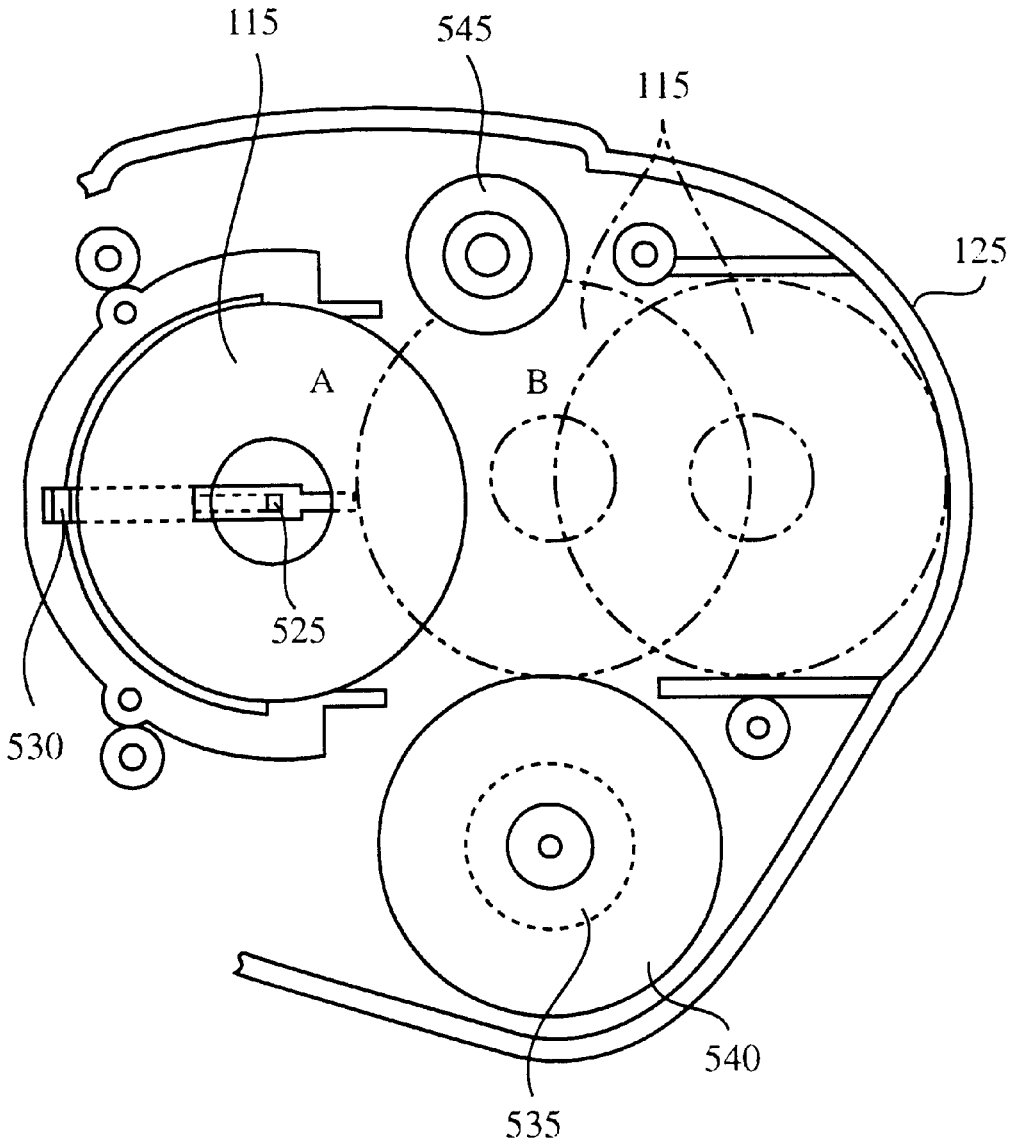
FIG. 5B is a top cross-sectional view of the toy body of FIG. 1, with portions removed to illustrate the interior.

Referring also to FIGS. 5A and 5B, the magazine 405 is shaped to hold the objects 115. For example, if the objects 115 are disc-shaped, then the magazine 405 may be a cylinder with a diameter somewhat wider than the diameter of the objects. The magazine 405 includes a top lid 500 that is pivotally opened using a knob 425. When the top lid 500 is pivoted to an open position, the objects 115 can be loaded into the magazine 405. When the top lid 500 is pivoted to a closed position, the objects 115 are retained in the magazine 405.

Inside the toy body 125, a trigger motor 505 couples to a trigger mechanism 510 which includes a four-joint rotational chain mechanism between links 515, 520 and the toy body 125. When the trigger motor 505 activates the trigger mechanism 510, link 520 is caused to rotate via link 515. As link 520 is rotated, the objects 115 held in the magazine 405 are forcibly fed to a discharging position.

Pawls 525, 530 are provided on the surface of link 520 to help facilitate this feeding action. The pawls 525, 530 both project into the upper compartment of the barrel 400. Of the two pawls, the pawl 525 confronts a hole in the object 115 held at the bottom of a stack of the objects 115 and functions as a stop for that bottom-most object 115. The pawl 530 is brought into contact with the rear portion of the bottom-most object 115 and functions to forcibly feed the object 115 to the discharging position when the trigger mechanism 510 is activated by the trigger motor 505.

Inside the toy body 125, a discharge or fire motor 535 couples to and rotatably drives a discharge mechanism that includes a driving roller 540 located near the barrel 400. The discharge mechanism also includes an idler roller 545 located on the other side of the barrel 400 so as to hold the object 115 between the two rollers.

In operation, the object 115 located at a position of the magazine 405 (a position indicated by the letter "A" in FIG. 5B) is fed to the discharging position (a position indicated by the letter "B" in FIG. 5B) by the trigger mechanism 510. The object 115 so fed is designed to be discharged forward by virtue of the rotation of the driving roller 545.

Detail of design and implementation of the trigger and discharge operations may be found in U.S. Pat. No. 5,471,967 issued on Dec. 5, 1995 to Matsuzaki et al., which is incorporated herein by reference.

Figure 6:
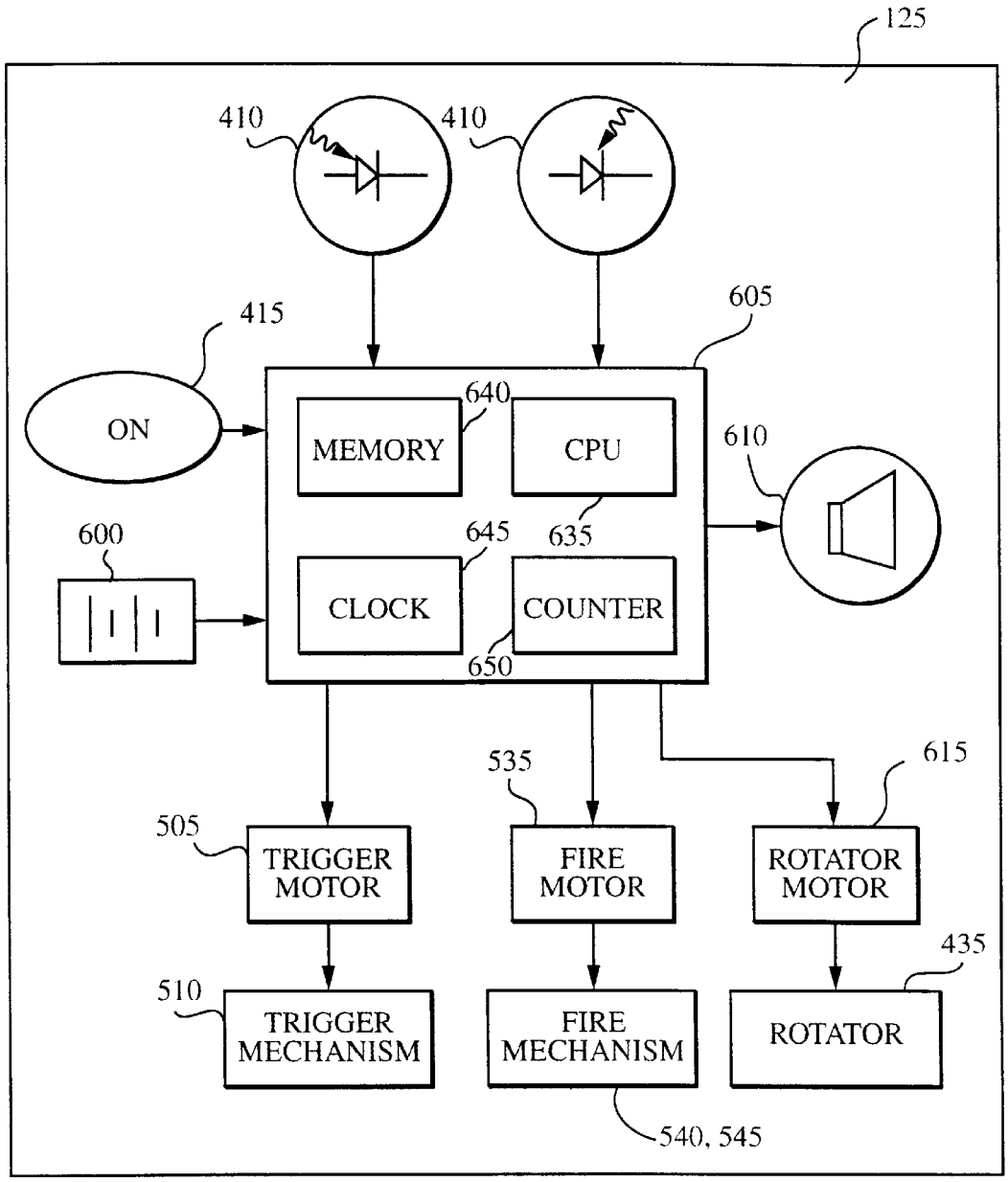
FIG. 6 is a block diagram of the toy body of FIG. 1.

Referring also to FIG. 6, the body 125 contains the power source 600, such as, for example, a battery that is retained in the compartment 430. The controller 605 is housed within the body 125 and receives input from the on button 415, the power source 600, and the signal detectors 410. Based on this input, the controller 605 controls the speaker 610, motors 505, 545, and a motor 615 that mechanically controls movement of the rotator 435. The controller 605 performs these tasks using additional information obtained from a processor 635, memory 640, a clock 645, and a counter 650.

Figure 7:
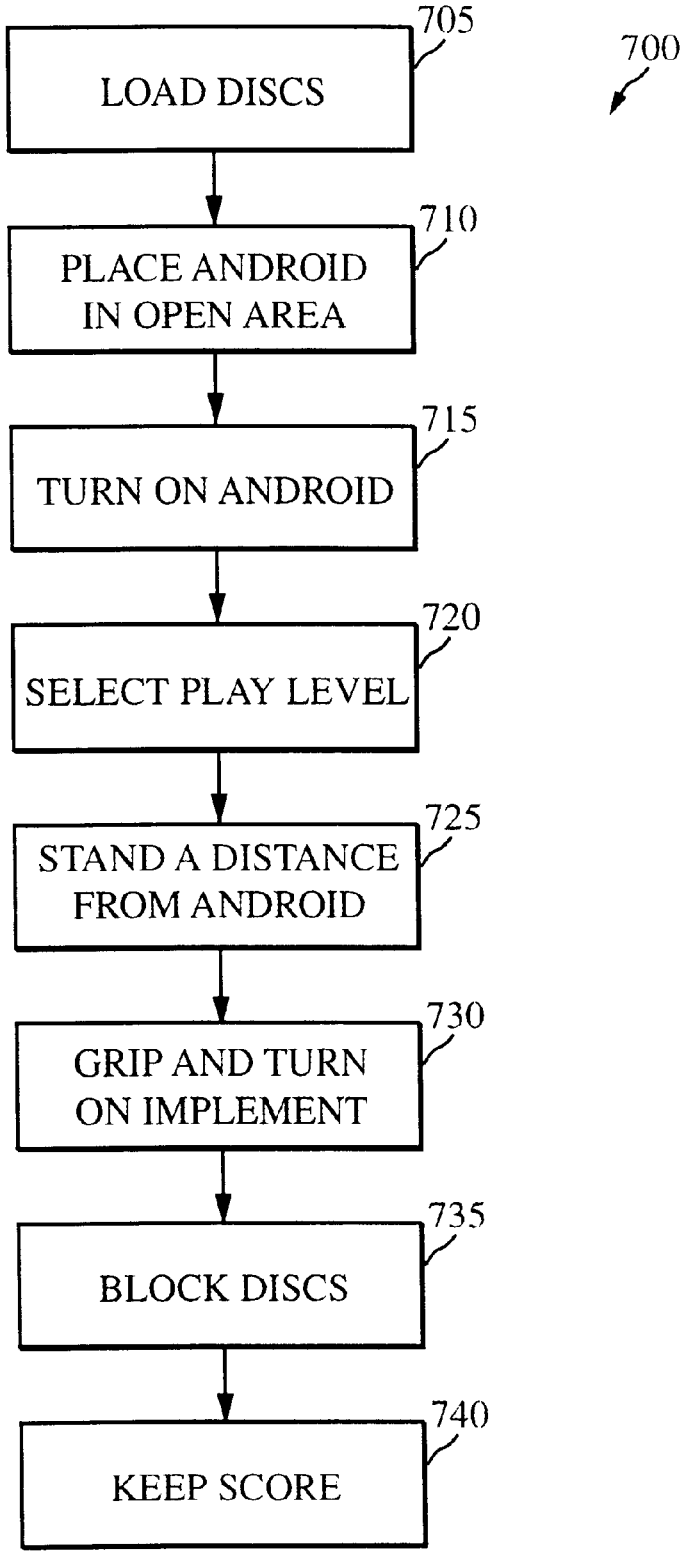
FIG. 7 is a flow diagram showing player operation of the game of FIG. 1.

Referring also to FIG. 7, the player 100 operates the game according to a procedure 700. The player 100 loads the objects 115 into the magazine 405 (step 705) and places the toy 110 in an open area (step 710). This setup reduces the chances that signal reflections from the device 105 will reach the signal detectors 410, which could potentially cause the toy body 125 to operate erratically.

After the player 100 turns on the toy body 125 using the on button 415 (step 715), the player 100 selects a play level (step 720) by pressing the on button 415 a preset number of times. For example, if the player 100 wishes to play at an easy play level, the player presses the on button 415 once, and if the player 100 wishes to play at a harder play level, the player presses the on button 415 twice. The play level indicates a level of difficulty in playing the game. At an easy play level, the toy body 125 may warn the player 100 with a preset number of sounds before shooting the object 115 at the player 100. On the other hand, at a harder play level, the toy body 125 may provide a shorter-duration warning, or no warning at all, to the player 100 before shooting the object 115 at the player 100.

Figure 8:
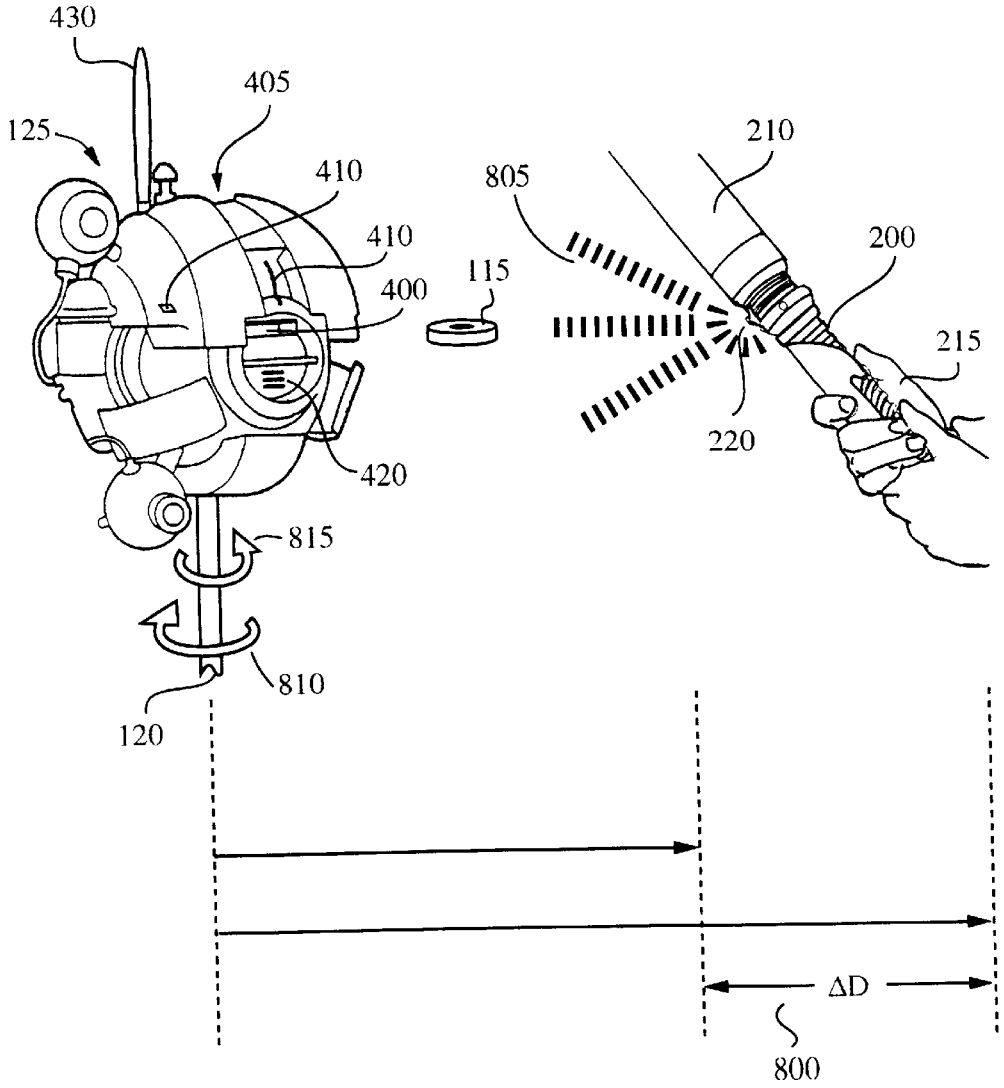
FIG. 8 is a perspective view of the game of FIG. 1 during game play.

Referring also to FIG. 8, the player 100 stands with the device 105 within a predetermined range $\Delta D$ 800 of distances from the body 125 (step 725). The predetermined range $\Delta D$ is based on the wavelength of the radiation (shown as wavefront 805) emitted from the device 105, the signal detectors 410 in the toy body 125, and the shape of the radiation from the emitter 220. When the signal detector 410 is too close to the emitter 220, the detector 410 may not be in the path of the emitted radiation. Whereas when the signal detector 410 is too far from the emitter 220, the signal may be too weak for the detector 410 to detect.

The player 100 grips the handle 200 and presses the on button 215 to turn on the device 105 (step 730). This activates the signal emitters 220 and the speaker 310. If the player 100 requires a rest during game play, the player may release the on button 215 for a preset number of seconds before the device 105 turns off.

When the toy body 125 shoots an object 115 through the barrel, the player 100 moves the device 105 toward the object 115 to block or strike the object 115 (step 735). When all of the objects 115 have been fired from the toy body's barrel 400 (that is, there are no objects 115 remaining in the magazine 405), the player 100 determines the score based on the total number of objects blocked (step 740).

Figure 9:
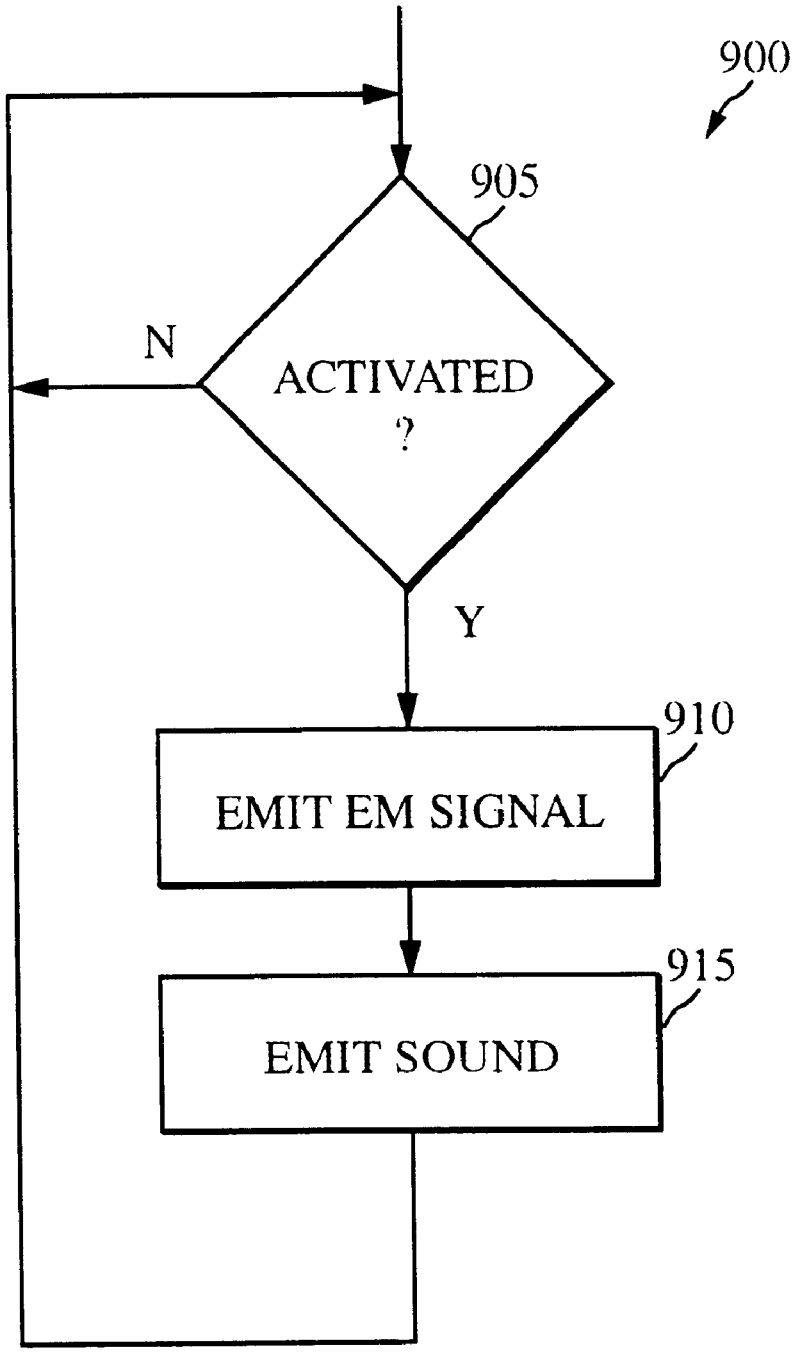
FIG. 9 is a flow diagram showing operation of the hand held device of FIG. 2.

Referring to FIG. 9, during game play, the device controller 305 performs a procedure 900. First, the controller 305 determines whether the device is activated by, for example, detecting whether the player has pressed the on button 215 (step 905). If the controller 305 determines that the device is activated, the controller 305 emits light or electromagnetic radiation from the light emitters 220 (step 910), and emits one or more sounds from the speaker 310 (step 915).

Figure 10:
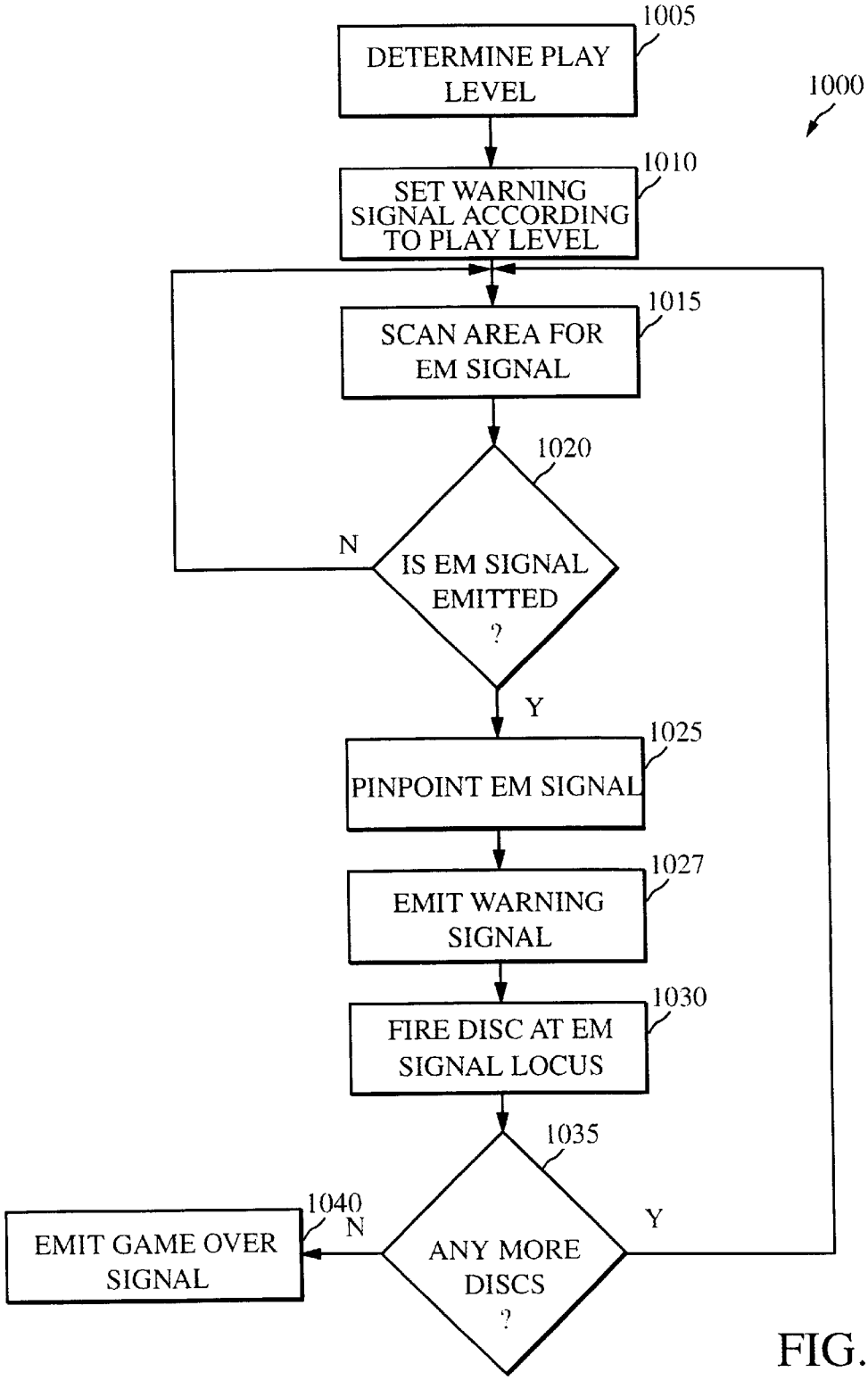
FIG. 10 is a flow diagram showing operation of the toy body of FIG. 1.

Referring to FIG. 10, the toy body controller 605 performed a procedure 1000 during game play. The controller 605 determines the play level input by the player 100 by counting the number of times the player presses the on button 415 (step 1005). Based on the play level, the toy body controller 605 selects an acoustic warning signal to be emitted by the speaker 610 before firing of the object from the barrel (step 1010). The acoustic warning signal may be set to include at least three beeps for an easy play level or at least two beeps for a harder play level.

The toy body controller 605 then scans the surrounding area for emitted electromagnetic radiation (step 1015). The controller 605 scans the area by first activating the motor 515. The motor 515, under control of the controller 605, moves the rotator 435 and causes the toy body 125 to rotate around the post 120 (shown as arrows 810, 815 in FIG. 8). In this way, the signal detectors 410 are able to scan a complete 360° around the post for the emitted light.

The toy body controller 605 determines whether light is emitted from the implement 105 (step 1020) by analyzing the output from the detector 410. The output from the detector 410 is an electrical signal that indicates energy of the detected electromagnetic radiation. If the controller 605 determines that the device 105 is emitting electromagnetic radiation (step 1020), then the toy body controller 605 tracks the emitted radiation until it pinpoints the location of the implement 105 (step 1025). The controller 605 tracks the emitted radiation by adjusting an output signal to the motor 615. The motor 615 moves the toy body via the rotator 435 in response to the analyzed output signal from the detector 410. In particular, the motor moves the toy body until a peak in the signal is detected, with the peak indicating that the toy body is facing the device. The controller 605 tracks the emitted radiation for a period of time before firing to reduce the possibility that stray light has been erroneously detected.

Once the controller 605 determines the location of the device 105 (step 1025), the speaker 610 emits the acoustic warning signal based on an electrical signal it receives from the controller (step 1027). The electrical signal depends on the play level determined at step 1005.

After emitting the acoustic warning signal, the controller 605 sends a trigger signal to the motor 505, which activates the trigger mechanism 510 to forcibly feed an object 115 into the discharge location. Then the controller 605 sends a fire signal to the discharge motor 535, which activates the fire mechanism (driving roller 540 and idler roller 545) to shoot an object 115 through the barrel 400 and toward the location of the emitted electromagnetic radiation (step 1030).

After an object 115 has been fired, the controller 605 determines whether there are any more objects 115 left in the magazine 405 (step 1035) by counting the number of objects 115 that have already been fired. Because a predetermined number of objects 115 can fit into the magazine 405, the controller 605 counts the number of times that the fire mechanism has been activated.

If there are more objects remaining in the magazine, then the controller 605 continues to scan the surrounding area for emitted light from the device (step 1015). If there are no more objects remaining in the magazine, then the controller 605 sends a game over signal to the speaker 610. The speaker 610 then emits an acoustic game over signal (step 1040) to indicate that all the objects have been fired. The acoustic game over signal may correspond to a voice of the android-like object. For example, the android-like object may give a speech when all objects have been fired. Once the player 100 hears the acoustic game over signal, the player can then count up the number of blocked objects to determine a score.

The toy 110 and device 105 may be used in a game in which the toy 110 represents a spy probe that locates the player. The spy probe, upon finding the player, releases a message disc (represented by the object) that informs the owner of the spy probe of the location of the player. The player's goal is therefore to block the message discs from ever reaching the owner of the spy probe. At the end of the game, the speaker 610, under control of the controller 605, would emit an acoustic game over signal that corresponds to the voice of the spy probe owner.

Other embodiments are within the scope of the following claims. For example, the LED or light emitter 220 may emit light of other wavelengths, for example, in the visible region. Likewise, the signal detectors 410 may detect light at wavelengths corresponding to the expected wavelength of light emitted from the light emitters 220.

To facilitate game play, the objects 115 may be made of different colors. Each color may represent a different point value. For example, when the player blocks an object of a blue color, the player receives, 5 points, whereas when the player blocks a yellow object, the player receives 1 point. The object 115 may be shaped into any form that facilitates aerodynamics, for example, spherical or toroidal forms would be suitable shapes.

The player may press the on button 215 to turn on the device 105 and then press the on button 215 to turn off the device 105.

The device may be designed to emit an acoustic signal and the toy body may be designed with acoustic detectors to detect the acoustic signal.

The rotator may cause the body to rotate around an axis other than the longitudinal axis of the post, giving the signal detectors the ability to scan through a wider range for the emitted light.

What is claimed is:

1. An electronic game comprising:

a device that is held or worn by a player, the device including an emitter that emits a signal; and a housing that includes:

a controller, a detector that detects the signal from the emitter and provides an electrical signal to the controller indicating the location of the emitter, a magazine for storing objects, a fire mechanism coupled to the magazine and controlled by the controller to fire a stored object at the device when the controller determines that the detector has detected an emitted signal from the emitter.

2. The electronic game of claim 1, wherein the device includes a speaker that emits one or more audio signals in response to player input.

3. The electronic game of claim 1, wherein the emitter emits the signal in response to player input.

4. The electronic game of claim 1, wherein the emitter includes a light emitting diode.

5. The electronic game of claim 1, wherein the signal emitted from the emitter is an electromagnetic signal.

6. The electronic game of claim 5, wherein the emitter is configured to emit the electromagnetic signal in the infrared wavelength region.

7. The electronic game of claim 6, wherein the detector is configured to detect the electromagnetic signal emitted in the infrared wavelength region.

8. The electronic game of claim 1, wherein the detector includes a photodiode detector.

9. The electronic game of claim 1, wherein the detector is configured to detect a signal based on characteristics of the signal.

10. The electronic game of claim 1, further comprising a post, wherein the housing includes a mechanical rotator that is electrically controlled by the controller and is coupled to the post.

11. The electronic game of claim 10, wherein the controller determination that the emitted signal has been detected includes causing the rotator to rotate the housing relative to the post and toward a signal source.

12. The electronic game of claim 11, wherein the controller determination that the emitted signal has been detected further includes determining whether a value of the electrical signal remains above a predetermined threshold for a predetermined period of time.

13. The electronic game of claim 12, wherein the controller causes a speaker in the housing to emit an acoustic warning signal when the controller determines that the detector has detected an emitted signal from the emitter.

14. The electronic game of claim 13, wherein the acoustic warning signal is predetermined and configured by the player.

15. The electronic game of claim 1, wherein the housing includes a speaker controlled by the controller to emit an acoustic signal.

16. The electronic game of claim 15, wherein the controller causes the speaker to emit an acoustic game over signal when the controller determines that a predetermined number of objects have been fired.

17. The electronic game of claim 1, wherein the object is made of a sponge-like material and is disc-shaped.

18. An electronic game comprising:

a device that is held or worn by a player, the device including an emitter that emits an electromagnetic signal in response to player input;

a post;

a housing mounted on the post and including:

a controller, a mechanical rotator coupled to the post and controlled by the controller to rotate the housing relative to the post and toward the emitter;

a detector that detects the electromagnetic signal from the emitter and provides an electrical signal to the controller indicating the location of the emitter, a magazine for storing objects, a fire mechanism coupled to the magazine and controlled by the controller to fire a stored object at the device when the controller determines that the detector has detected an emitted signal from the emitter;

wherein the controller determines that the detector has detected an emitted signal by determining whether a value of the electrical signal remains above a predetermined threshold for a predetermined period of time.

* * * * *